United States Patent [19]

Withers

[11] Patent Number: 4,707,702

[45] Date of Patent: Nov. 17, 1987

[54] CIRCULARLY POLARIZING ANTENNA FEED

[75] Inventor: Michael J. Withers, Bordon, England

[73] Assignee: National Research Development Corporation, London, England

[21] Appl. No.: 818,546

[22] Filed: Jan. 13, 1986

[30] Foreign Application Priority Data

Jan. 21, 1985 [GB] United Kingdom ..... 8501440

[51] Int. Cl.[4] ..... H01Q 19/00

[52] U.S. Cl. ..... 343/786; 343/756; 343/776; 343/783; 343/772; 333/21 A

[58] Field of Search ..... 343/756, 776, 772, 778, 343/783, 786, 909; 333/21 A

[56] References Cited

U.S. PATENT DOCUMENTS

| | | | |
|---|---|---|---|
| 2,942,260 | 6/1960 | Carter | 343/754 |
| 3,955,202 | 5/1976 | Young | 343/756 |
| 4,412,222 | 10/1983 | Möhring | 343/786 |
| 4,420,729 | 12/1983 | Ashforth | 333/21 A |
| 4,427,984 | 1/1984 | Anderson | 343/764 |
| 4,527,165 | 7/1985 | de Ronde | 343/778 |

FOREIGN PATENT DOCUMENTS

| | | |
|---|---|---|
| 690027 | 4/1953 | United Kingdom . |
| 807557 | 1/1959 | United Kingdom . |
| 850528 | 10/1960 | United Kingdom . |

OTHER PUBLICATIONS

Japanese Patent Abstracts, vol. 8, No. 119, JP-5-9-32204.

Japanese Patent Abstracts, vol. 6, No. 144, JP-5-7-67301.

Japanese Patent Abstracts, vol. 9, No. 49, JP-5-9-189702.

*Primary Examiner*—William L. Sikes
*Assistant Examiner*—Doris J. Johnson
*Attorney, Agent, or Firm*—Paul & Paul

[57] ABSTRACT

A circularly polarizing antenna feed comprises a feed waveguide having a short circuit reflecting plate at one end and a radiating horn at the other, a wave exciter for launching linearly polarized plane waves axially along the feed waveguide in opposite directions, and a grid of parallel reflector strips disposed in a plane which is perpendicular to the waveguide axis and which is located between the wave exciter and the reflecting termination at a distance of approximately λg/8 from the exciter and approximately λg/4 from the termination. The reflecting strips of the grid are inclined at an angle of 45° to the direction of polarization of the waves propagated by the exciter, the grid and the reflecting termination together forming a twist reflector which effectively reflects and rotates through 90° the waves incident upon the grid. These reflected waves together with the forwardly propagated waves from the exciter represent circularly polarized waves. As an alternative to the reflector grid the feed may comprise a metal septum plate which has an axial length of λg/4 and which is disposed in the waveguide in an axial plane inclined at 45° to the polarization direction of waves propagated by the exciter and so that its front edge is located λg/8 behind the exciter.

12 Claims, 9 Drawing Figures

CIRCULARLY POLARIZING ANTENNA FEED

This invention relates to a circularly polarizing feed for microwave antennas such as are used in communications systems, particularly satellite communications systems.

Circularly polarized transmission is generally used when the polarization alignment between the axes of the transmitting and receiving antennas cannot be maintained easily, since it overcomes the variation in coupling that would be experienced if linearly polarized signals were to be used. Constant coupling with axial rotation of either the transmitting or receiving antenna will be obtained if either antenna is circularly polarized, but a loss of 3 dB is experienced compared with using two correctly matched circularly polarized antennas.

There are two basic ways of generating circularly polarized waves. The first is to use a radiating element which naturally generates a circularly polarized wave, such as a spiral or helical element. The second is to use an element which generates a linearly polarized wave and to pass the wave through a polarizer which converts the linearly polarized wave into a circularly polarized wave. There are a wide variety of such polarizers, such as the dielectric vane, corrugated wall, septum, and screw types, and also the plate types such as the quarter wave plate and the meander line plate, and all work on the principle of using an asymmetric structure oriented at 45° to the linearly polarized wave for the purpose of resolving the linearly polarized wave into two orthogonal waves and delaying one by 90° more than the other as they propagate through the device. The resulting orthogonal equal amplitude linearly polarized waves with one delayed or advanced with respect to the other by 90° gives a circularly polarized wave of a hand (i.e. left-hand or right-hand) depending on which wave is delayed with respect to the other.

A major problem with most of these polarizers, however, is to obtain a good electrical match with the adjacent components in the antenna feed, and generally this can only be achieved by making the polarizer several wavelengths long. Since the polarizer is located between the wave generating component and the horn of the antenna feed, this gives rise to a feed of considerable length. In addition, there are generally manufacturing problems in constructing a long asymmetric component to high tolerances, leading to high costs.

With the aim of avoiding these problems, according to the present invention, a circularly polarizing antenna feed comprises a horn and a feed waveguide which extends axially from the throat of the horn and which is provided with a wave exciter for exciting linearly polarized plane waves which propagate in opposite directions axially along the waveguide, a wave splitter having a reflecting portion which extends across the waveguide at a distance of substantially $\lambda/8$ (where $\lambda$ is the wavelength in the waveguide at the mean operating frequency) behind the wave exciter with respect to the horn and which is inclined to the polarization direction of the waves at an angle of 45° measured in a plane which is perpendicular to the waveguide axis, and a terminal reflecting plane located behind the wave splitter at a distance of substantially $\lambda/4$ from the reflecting portion of the wave splitter.

The wave splitter and the terminal reflecting plane together constitute what is known as a twist reflector, having the property of reflecting an incident linearly polarized plane wave as a linearly polarized plane wave rotated through 90°. In other words, an incident vertically polarized wave will be reflected as a horizontally polarized wave, and vice versa. Thus, by appropriately setting the spacing between the wave exciter and the twist reflector, it can be arranged that the rotated wave reflected by the twist reflector, on returning to the plane of the wave exciter, will be phase advanced or delayed by 90° with respect to the waves then being propagated, with the result that the direct and reflected waves propagating towards the horn cause a circularly polarized wave to be radiated by the horn. As stated, the distances between the wave exciter, the reflecting portion of the wave splitter, and the terminal reflecting plane are approximately $\lambda/8$ and $\lambda/4$ respectively, but the actual distances will depend on the susceptance of the wave splitter and will be such as to produce the required phase relationships between the waves at the reflecting portion and the exciter.

The hand of circular polarization which is radiated depends upon whether the wave rotated by the twist reflector is phase advanced or delayed with respect to the directly propagated wave at the wave exciter, and in the system in accordance with the invention this depends on whether the wave splitter is angled at +45° or −45° with respect to the polarization direction of the waves propagated from the exciter. Consequently, the hand of circular polarization which is radiated can be changed simply by rotating the wave splitter through 90°, and, by providing the feed in accordance with the invention with two wave exciters at right angles to each other in a common plane perpendicular to the waveguide axis, the feed will be capable of dual polarized operation, one exciter producing a left-hand circular polarization and the other producing right-hand circular polarization. The isolation between the two hands will be dependent upon the purity of the waves generated.

The wave exciter comprises a co-axial probe projecting radially into the waveguide.

The wave splitter preferably comprises a grid of parallel reflectors extending across the waveguide in a plane perpendicular to the waveguide axis and inclined at an angle of 45° to the polarization direction of the waves excited by the wave exciter. In this case the grid preferably comprises a number of parallel metallic wires or strips carried by a dielectric support member, and may be formed by photo-etching copper on a thin dielectric membrane, such as Kapton (Registered Trade Mark). The number and spacing of the strips will be selected to provide the grid with an appropriate susceptance behaviour over the operating bandwidth. This bandwidth is governed by the longest interacting electrical length in the system, which is approximately 3 $\lambda/4$, and a reasonable operating bandwidth of about 4% (i.e. about 25 dB rejection or 1 dB axial ratio) can be obtained with a single grid twist reflector. However, by using a second reflector grid suitably spaced from the first and having its reflecting strips parallel to those of the first grid, it is possible that a much greater operating bandwidth may be achieved, and in this case the two grids may be formed by photo-etching copper wires on opposite sides of a suitable thickness dielectric sheet.

Alternatively, the wave splitter may comprise a metal septum plate which extends across the waveguide in an axial plane inclined at an angle of 45° to the polarization direction of the waves excited by the wave exciter and which has an axial length of substantially $\lambda/4$. As will be appreciated, in this case the front edge of the plate forms the reflecting portion, and the length of the plate is such that it extends back to the terminal reflecting plane.

The feed in accordance with the invention may comprise a circular waveguide and a conical horn, or a square waveguide and a pyramidal horn, and may form part of a reflector antenna or an array.

The feed may be constructed simply and easily as a sandwich of components, a member carrying the wave exciter being clamped axially between the horn and a spacer ring, and an end cap forming the terminal reflecting plane being clamped axially to the spacer ring to hold the wave splitter in position. The horn, the spacer ring, and the end cap are all circularly symmetric and are therefore easily manufactured to a suitable degree of accuracy by any one of a wide range of low cost manufacturing techniques. The exciter, at least in the form of a probe, and the wave splitter in the form of a grid of parallel reflectors are readily made using printed circuit techniques.

It will be appreciated therefore that a circularly polarizing antenna feed in accordance with the invention can be made which is both relatively simple and inexpensive to manufacture and which is almost as compact as an equivalent linearly polarizing feed. The hand of circular polarization can be changed simply by rotating the wave splitter through 90°, and dual polarization is possible using two orthogonal exciters.

Furthermore, as already mentioned, the feed can be combined with a plurality of similar feeds to form a planar array antenna. In this case a common sandwich construction for the individual feeds of the array is most practical, comprising a first layer having a plurality of holes defining the horns, a second layer comprising a thin dielectric membrane having the exciter probes printed on it for operation as a suspended substrate line, and a third layer which is substantially $\lambda/8$ thick and has a plurality of holes aligned with the holes of the first layer. If the wave splitters are grids of parallel reflectors, the construction will further comprise a fourth layer comprising a sheet of dielectric carrying a diagonal pattern of parallel metal strips at 45° to the probes, and a fifth layer containing a plurality of blind holes which are substantially $\lambda/4$ deep and are aligned with the holes of the first and third layers. If the wave splitters are septum plates, the construction will instead further comprise a fourth layer having a plurality of blind holes which are substantially $\lambda/4$ deep and are aligned with the holes of the first and third layers and each of which contains a metal plate extending across it in an axial plane inclined at an angle of 45° to the exciter probes and extending throughout the whole depth of the hole. The layers, except where otherwise stated, may be made of metallised injection moulded plastics material, or may be pressed and pierced metal sheets, all of the layers being suitably clamped or glued together.

The principles of the circularly polarizing antenna feed in accordance with the invention will now be described further with reference to the accompanying diagrammatic drawings, in which.

In the examples illustrated the feed comprises a circular feed waveguide 1 which is closed at one end by a reflecting end plate 2 and which is connected at its other end to the throat of a conical radiating horn 3, the waveguide 1 being capable of supporting a $TE_{11}$ mode over the selected operating frequency band. A co-axial probe 4 projects radially through the wall of the waveguide 1 for the purpose of exciting linearly polarized plane waves which propagate axially in the waveguide 1 in opposite directions away from the probe 4.

Figure 1:
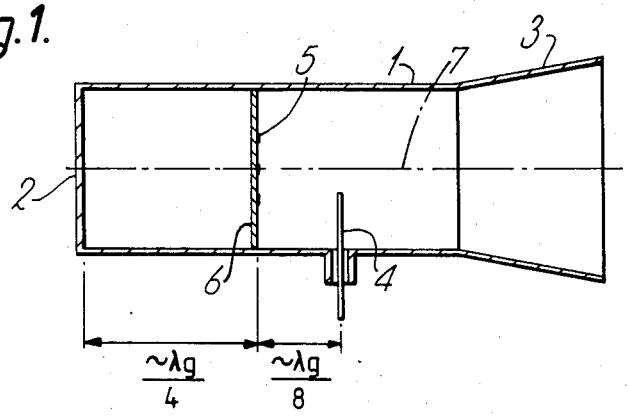
FIG. 1 is an axial section through one example of a feed in accordance with the invention.
Figure 2:
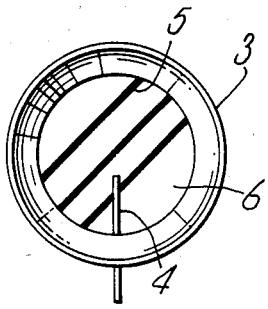
FIG. 2 is an end view of the feed shown in FIG. 1 looking towards the horn.
Figure 3:
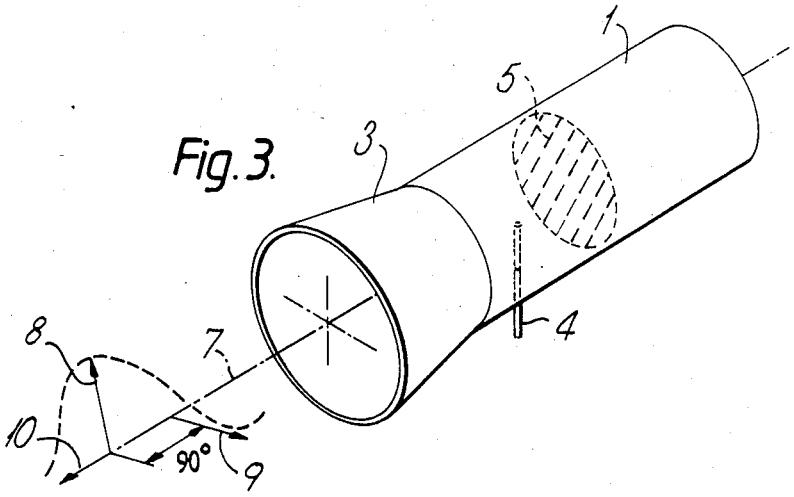
FIG. 3 is a perspective view of the feed illustrating the propagation of a circularly polarized wave.

In the example shown in FIGS. 1 to 3, between the probe 4 and the end plate 2 the waveguide 1 has a grid of parallel reflectors 5 comprising metal strips deposited on a dielectric support membrane 6 disposed in a plane perpendicular to the axis 7 of the waveguide. The metal wire or strip reflectors 5 are inclined at an angle of 45° to the probe 4 (and therefore to the direction of polarization of the linearly polarized waves propagated from the probe), and the grid is positioned approximately $\lambda/8$ from the probe and approximately $\lambda/4$ from the end plate 2. The exact distances will depend upon the susceptance of the reflector grid 5, which will affect the phase difference between the incident and reflected waves, and the distances will therefore be chosen so as to achieve the desired phase relationship between incident and reflected waves as described below.

The end plate 2 and the grid 5 together form a twist reflector and, in operation, a plane wave propagated rearwards (i.e. towards the grid 5) from the probe 4 is incident on the grid 5 and effectively resolved into two waves, one parallel to the reflector strips and the other perpendicular to the strips. The wave component parallel to the strips is reflected, undergoing 180° phase reversal, and the perpendicular wave component passes through the grid to the end plate 2 where it is reflected back towards the grid. On passing back through the grid this perpendicular wave component will have undergone a total of 360° of phase delay and effectively recombines with the parallel wave component reflected from the grid to provide a resultant reflected plane wave linearly polarized at right angles to the original incident wave. In other words, a linearly polarized plane wave incident on the grid 5 from the probe 4 is effectively reflected and rotated through 90°.

By appropriately setting the distance between the grid 5 and the probe 4, this reflected and rotated wave is phase delayed or advanced by 90° with respect to the linearly polarized plane wave propagated forwardly from the probe at that instant and together they constitute a circularly polarized wave propagated towards and through the horn. This is illustrated in FIG. 3 by the directly propagated wave 8 and the orthogonal reflected wave 9 propagating in the same direction 10 and phase delayed by 90°.

Figure 4:
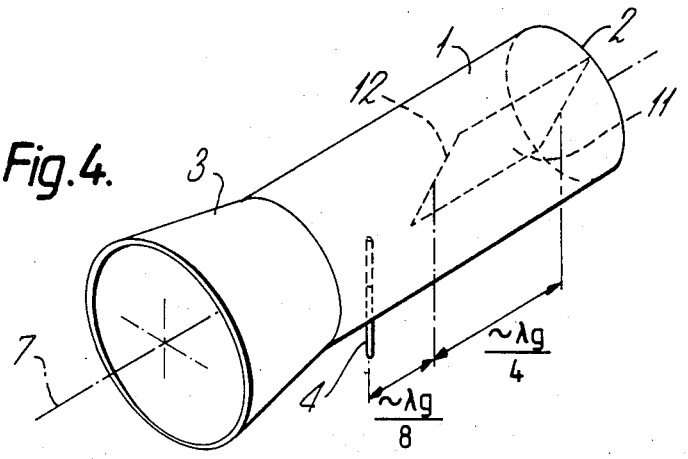
FIG. 4 is a perspective view illustrating an alternative example of a feed in accordance with the invention; and, FIG. 5 is an end view of the feed shown in FIG. 4 looking towards the horn.
Figure 5:
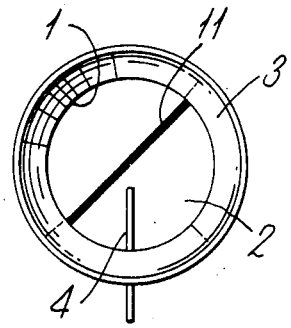

In the example of FIGS. 4 and 5, instead of the reflector grid 5, the waveguide 1 has a conducting metal septum plate 11 positioned between the probe 4 and the end plate 2 with its leading edge 12 at a distance of approximately λ/8 from the probe. The septum plate 11 lies in an axial plane inclined at 45° to the polarization direction of the linearly polarized waves propagated from the probe 4, and has an axial length of approximately λ/4. The septum plate 11 and the reflecting end plate 2 form a twist reflector which operates in exactly the same way as that formed by the reflector grid 5 and the end plate 2 in the example of FIGS. 1 to 3 and, as in that example, the exact distances between the probe 4, the front edge 12 of the plate 11, and the end plate 2 will depend on the susceptance of the septum plate 11 to the two resolved polarized waves within the twist reflector, the distances being chosen so as to achieve the desired phase relationship between the incident and reflected waves as described earlier.

Figure 6:
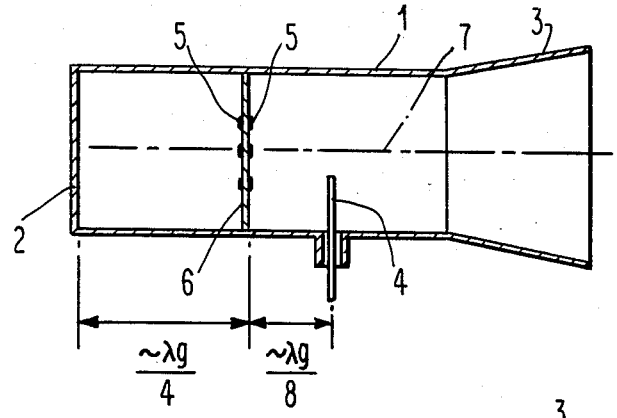
FIG. 6 is an axial section through another example of feed in accordance with this invention.

In the example of FIG. 6 the wave splitter comprises a dielectric support member 6 and a plurality of parallel metallic strips 5 on opposite sides of the dielectric support member 6 forming two grids of parallel reflectors. The metallic strips 5 are of copper photo-etched on the support member 6.

Figure 7:
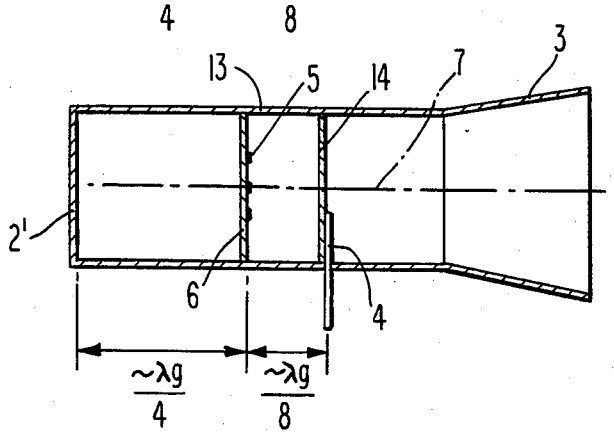
FIG. 7 is an axial section through another example of feed in accordance with this invention.

In the example of FIG. 7 the feed is constructed as a sandwich of components. The sandwich comprises the horn 3, a spacer ring 13, a member 14 carrying the launching probe 4 and clamped axially between the horn 3 and the spacer ring 13, a wave splitter 6, and an end cap 2 forming the terminal reflecting plane and clamped axially to the spacer ring 13 to hold the wave splitter 6 in position.

Figure 8:
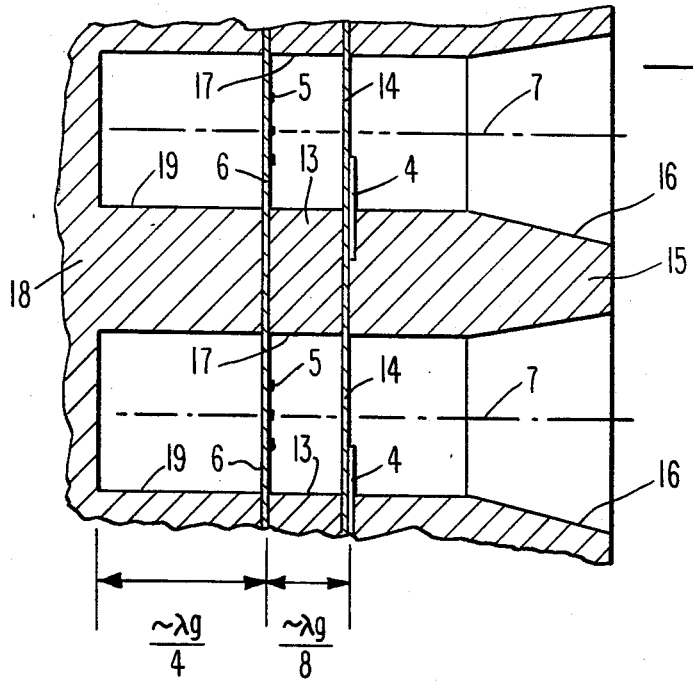
FIG. 8 is an axial section through part of one planar array antenna.

In the example of FIG. 8 a number of feeds similar to that shown in FIG. 7 are combined to form a planar array antenna. The individual feeds of the array have a common sandwich construction comprising a first layer 15, a plurality of holes 16 in the first layer 15 to form the horns, a second layer consisting of a thin dielectric membrane 14, a third layer 13 which is substantially λ/8 thick and includes a plurality of holes 17 aligned with the holes 16 of the first layer 15. The second layer has launching probes 4 printed on the thin dielectric membrane 14 in alignment with the holes 16 and 17 and mounted between the first and third layers for operation as a suspended substrate line. A fourth layer comprises a sheet of dielectric 6 and a diagonal pattern or parallel metal strips 5 carried by the dielectric sheet 6 at an angle of 45± to the exciter probes 4. A fifth layer 18 contains a plurality of blind holes 19 which are substantially λ/4 deep and are aligned with the holes 16 and 17 of the first and third layers.

Figure 9:
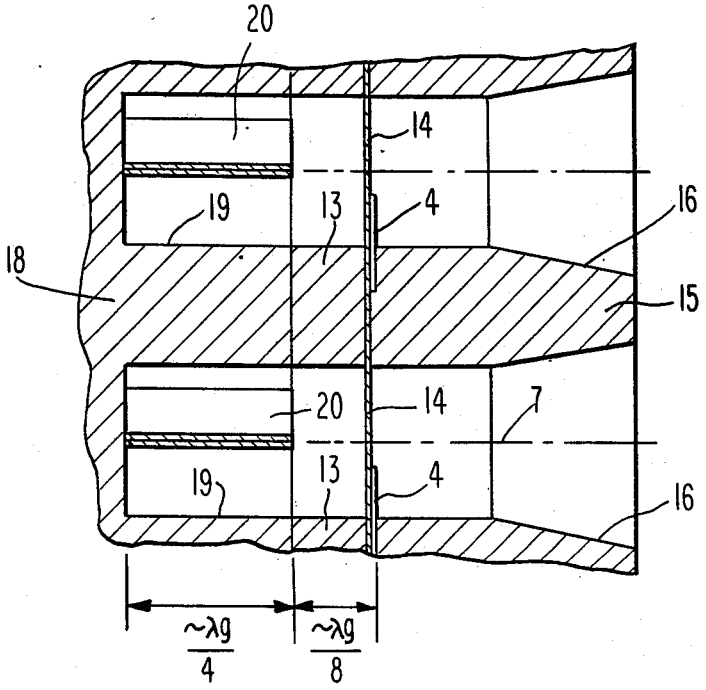
FIG. 9 is an axial section through part of another planar array antenna.

The example of FIG. 9 is generally similar to that shown in FIG. 8 but includes a septum plate like the example shown in FIG. 4. Thus the planar array antenna having a sandwich construction comprises a first layer 15 including a plurality of holes 16 to form the horns, a second layer consisting of a thin dielectric membrane 14, and a third layer 13 which is substantially λ/8 thick and includes a plurality of holes 17 aligned with the holes 16 of the first layer 15. The second layer has launching probes 4 printed on the thin dielectric membrane 14 in alignment with the holes 16 and 17 mounted between the first 15 and third 13 layers for operation as a suspended substrate line. A fourth layer 18 includes a plurality of blind holes 19 which are substantially λ/4 deep and are aligned with the holes 16 and 17 of the first 15 and third 13 layers. Each of the holes 19 of the fourth layer 18 contains a metal plate 20 extending across it in an axial plane inclined at an angle of 45± to the exciter probes 4 and extending throughout the whole depth of the hole 19.

I claim:

1. A circularly polarizing feed for a microwave antenna, said feed comprising a horn having an aperture end and a throat end, and a feed waveguide extending axially from said throat end of said horn, said feed waveguide including a co-axial launching probe projecting radially into said feed waveguide for exciting linearly polarized plane waves which propagate in opposite directions axially along said waveguide, a wave splitter including a reflecting portion, said reflecting portion extending across said waveguide at a distance of substantially λ/8 (where λ is the wavelength in said waveguide at a mean operating frequency) behind said co-axial launching probe with respect to said horn and being inclined at an angle of 45± to the polarization direction of said linearly polarized plane waves excited by said co-axial launching probe, said angle being measured in a plane perpendicular to said waveguide axis, and a terminal reflecting plane located behind said wave splitter at a distance to substantially λ/4 from said reflecting portion of said wave splitter.

2. An antenna feed as claimed in claim 1, wherein said wave splitter comprises a grid of parallel reflectors extending across said waveguide in a plane perpendicular to said waveguide axis and inclined at an angle of 45° to said polarizing direction of said by said co-axial launching probe wave exciter.

3. An antenna feed as claimed in claim 2, wherein said wave splitter comprises a dielectric support member and a plurality of parallel metallic strips carried by said support member and forming said grid of parallel reflectors.

4. An antenna feed as claimed in claim 3, wherein there are a plurality of parallel metallic strips on opposite sides of said dielectric support member forming two grids of parallel reflectors, said metallic strips being of copper photo-etched on said support member.

5. An antenna feed as claimed in claim 1, wherein said wave splitter comprises a metal septum plate extending across said waveguide in an axial plane inclined at an angle of 45° to said polarisation direction of said waves excited by said wave exciter, said septum plate having an axial length of substantially λ/4.

6. An antenna feed as claimed in claim 1, wherein said wave splitter is rotatable through 90° about said axis of said feed waveguide.

7. An antenna feed as claimed in claim 5 wherein said wave splitter is rotatable through 90° about said axis of said feed waveguide.

8. An antenna feed as claimed in claim 1, wherein said feed waveguide includes two of said plane wave exciters co-axial launching probes at right angles to each other in a common plane perpendicular to said waveguide axis.

9. An antenna feed as claimed in claim 1, wherein said feed is constructed as a sandwich of components, said sandwich comprising said horn, a spacer ring, a member carrying said launching probe and clamped axially between said horn and said spacer ring, said wave splitter, and an end cap forming said terminal reflecting plane and clamped axially to said spacer ring to hold said wave splitter in position.

10. An antenna feed as claimed in claim 1, wherein said feed is combined with a plurality of similar feeds to form a planar array antenna.

11. An antenna feed as claimed in claim 10, wherein the individual feeds of said array have a common sandwich construction comprising a first layer, means defining a plurality of holes in said first layer to form said horns, a second layer consisting of a thin dielectric membrane, a third layer which is substantially λ/8 thick and includes means defining a plurality of holes aligned with said holes of said first layer, said second layer having launching probes printed on said thin dielectric membrane in alignment with said holes and being mounted between said first and third layers for operation as a suspended substrate line, a fourth layer comprising a sheet of dielectric and a diagonal pattern of parallel metal strips carried by said dielectric sheet at an angle of 45° to said launching probes, and a fifth layer containing a plurality of blind holes which are substantially λ/4 deep and are aligned with said holes of said first and third layers.

12. An antenna feed as claimed in claim 10, wherein the individual feeds of said array have a common sandwich construction comprising a first layer including means defining a plurality of holes in said first layer to form said horns, a second layer consisting of a thin dielectric membrane, a third layer which is substantially λ/8 thick and includes means defining a plurality of holes aligned with said holes of said first layer, said second layer having launching probes printed on said thin dielectric membrane in alignment with said holes and being mounted between said first and third layers for operation as a suspended substrate line, and a fourth layer including means defining a plurality of blind holes which are substantially λ/4 deep and are aligned with said holes of said first and third layers, each of said holes of said fourth layer containing a metal plate extending across it in an axial plane inclined at an angle of 45° to said launching probes and extending throughout the whole depth of said hole.

* * * * *